United States Patent [19]

Bodine

[11] Patent Number: 4,527,637

[45] **Date of Patent: * Jul. 9, 1985**

[54] CYCLOIDAL DRILL BIT

[76] Inventor: Albert G. Bodine, 7877 Woodley Ave., Van Nuys, Calif. 91406

[ * ] Notice: The portion of the term of this patent subsequent to Apr. 14, 1998 has been disclaimed.

[21] Appl. No.: 505,954

[22] Filed: Jun. 20, 1983

Related U.S. Application Data

[63] Continuation-in-part of Ser. No. 262,650, May 11, 1981, Pat. No. 4,403,665, which is a continuation-in-part of Ser. No. 76,194, Sep. 17, 1979, Pat. No. 4,266,619, which is a continuation-in-part of Ser. No. 64,046, Aug. 6, 1979, Pat. No. 4,261,425.

[51] Int. Cl.[3] ..... E21B 7/24

[52] U.S. Cl. ..... 175/55; 175/107

[58] Field of Search ..... 175/55, 56, 343, 371, 175/354, 107

[56] References Cited

U.S. PATENT DOCUMENTS

| | | | |
|---|---|---|---|
| 2,336,335 | 12/1943 | Zublin | 175/354 |
| 2,815,928 | 12/1957 | Bodine | 175/56 |
| 2,938,710 | 5/1960 | Tannehill | 175/343 |
| 3,138,213 | 6/1964 | Brandon | 175/56 |
| 4,157,122 | 6/1979 | Morris | 175/371 |
| 4,168,755 | 9/1979 | Willis | 175/343 |
| 4,235,295 | 11/1980 | Zyglewyz | 175/371 |
| 4,261,425 | 4/1981 | Bodine | 175/55 |
| 4,266,619 | 5/1981 | Bodin | 175/55 |
| 4,270,812 | 6/1981 | Thomes | 175/371 |

*Primary Examiner*—William F. Pate, III

*Attorney, Agent, or Firm*—Edward A. Sokolski

[57] ABSTRACT

Sonic energy in a cycloidal or quadrature wave action pattern is generated in a drill stem by means of a sonic oscillator employing an eccentrically weighted rotor. The sonic energy is transmitted down the drill stem to the drill bit to cause precession of the bit around the bottom of the drill bore in a cycloidal fashion. This causes highly effective cutting action of both the bottom and the immediately adjacent side walls of the bottom portion of the bore by virtue of the cycloidal precessing action. In one embodiment of the invention, the drill stem is attached directly to the drill bit such that a nutating type action occurs. In other embodiment of the invention, the drill stem is coupled to the drill bit through an appropriate bearing, which may be a sleeve bearing or a roller bearing, which permits separate rotation of the bit on the drill stem in an orbiting cycloidal fashion.

13 Claims, 11 Drawing Figures

CYCLOIDAL DRILL BIT

This application is a continuation-in-part of my application Ser. No. 262,650, filed May 11, 1981 No. 4,403,665 which is a continuation in part of Ser. No. 76,194, Sept. 17, 1979, U.S. Pat. No. 4,266,619 which is a continuation in part of Ser. No. 64,046, Aug. 6, 1979, U.S. Pat. No. 4,261,425.

This invention relates to a cycloidal drill bit, and more particularly to such a device which employs sonic energy for driving the bit in a cycloidal precessional manner.

Typical prior art drilling bits are driven longitudinally to provide a drilling action which is essentially along the longitudinal axis of the drill stem. Bore hole drills employing sonic energy are described in my Pat. Nos. 4,266,619, issued May 12, 1981, and 4,271,915 issued June 9, 1981. In the '915 patent, an orbiting mass oscillator is employed which causes nutation of the drill bit by virtue of longitudinal vibrational energy transferred thereto through the drill stem. The rotating force vector developed in the device of the '915 patent causes the stem to cyclically elastically stretch and compress longitudinally to cause the bit to roll about the work material to effect longitudinal drilling action. In the '619 patent, the rotating force vector causes a portion of the drill and stem assembly above the drill bit to precess or roll around against the wall of the bore hole to cause rotation of the drill stem about its own axis in effecting the drilling action. In neither of these devices is the drill bit itself caused to cycloidally precess against the bottom of the bore hole to effect lateral as well as longitudinal drilling action. The aforementioned patent No. 4,403,665, of which the present application is a continuation-in-part describes a cycloidal pile driver in which spiral flanges or sloping ridges on the wall of the column are employed for use in driving a pile, a cycloidal rotary driving force being employed for propelling the pile into the earth with these flanges or flutes engaging the bore hole walls to provide a longitudinal bias force with such engagement.

The present invention involves an improved apparatus and technique for drilling a bore hole in which cycloidal precessional energy is applied to the drill bit, either directly or through suitable bearings, to cause the bit to cycloidally precess around the bottom of the bore hole so as to provide both lateral and longitudinal drilling action. This has several advantages over the prior art. First, this type of drill employs a number of cutter teeth which "fill" the bore hole enabling greatly increased drill life. Secondly, the cycloidal precessing tooth action subjects the earthen formation to a changing angle of attack to bit action which provides a very effective chipping of the earthen material. This variation of the angle of attack of the bit leads to more effective sonic weakening of the formation. The chipping action tends to chip out relative large pieces of rock which avoids wasting energy in grinding the material into fine particles. Further, such larger chips provide more meaningful geological data during drilling. In the embodiments of the invention wherein turn bearings are employed to permit the bit to rotate, which obviates the need to rotate the drill stem to achieve rotation of the bit, several advantages accrue. First, this facilitates directional drilling with a bent drill collar. Secondly, due to the non-rotation of the drill string, it is possible to employ coiled-up tubing for this string which can be fed from a reel. Further, no twisting action need to be handled by the drill stem in this device which enables the use of an electrical motor hanging from a cable for driving the drill.

In addition, in the drilling of deep bore holes, the device of the present invention ameliorates a problem often encountered in the loss of gauge of the well diameter, This normally occurs due to a decrease in the diameter of the drill bit with wear. This often makes it impossible for a new full diameter bit to fit through the bore to the bottom of the bore hole. Thus, quite often, the lower part of the well must be reamed before a new bit can be used, resulting in a significant increase in operational expenses. Utilizing the apparatus and technique of the present invention, the bore hole is always substantially larger in diameter than the drill bit itself in view of the lateral cutting action. This obviates any problem in placing a new bit in position at the bottom of the bore hole when an old bit needs to be replaced. This new combination causes the side wall engaging teeth to cycloidaly roll and cut the engaged portion of the side wall, while the teeth on the opposite side of the bit swing clear, without sliding and wear, because the bit makes the hole oversize.

Briefly described, the device and technique of the invention are as follows: An orbiting mass oscillator is installed on a drill string, this oscillator having an eccentrically weighted rotor which is positioned to generate a cycloidal vibratory force pattern about the longitudinal axis of the stem. The cycloidal vibratory force generated in the stem is transmitted down the stem to the region of the drill bit and causes the bit to precess cycloidally around the bottom of the bore hole providing cutting action about the sides as well as the bottom of the hole. In one embodiment of the invention, the drill stem is connected directly to the bit such that the cycloidal vibratory energy causes the bit to nutate around the wall of the bore hole. In other embodiments of the invention, the drill stem is coupled to the bit through bearings which may be of the roller or sleeve bearing type such that the bit is free to roll around the bore hole wall in orbital fashion and also strike the bottom of the hole periodically because the bit rocks in nutation.

It is therefore an object of this invention to facilitate the drilling of wells by providing means for causing the bit to simultaneously cut in both lateral and longitudinal directions.

It is still a further object of this invention to ameliorate the effects of loss of gauge in drilling deep wells.

It is still another object of this invention to enable rotation of a drill bit without having to rotate the drill stem.

It is still a further object of this invention to improve the cutting action of a drill by subjecting the earthen formation to a changing angle of attack of bit action.

Other objects of this invention will become apparent as the description proceeds in connection with the accompanying drawings of which:

Figure 1:
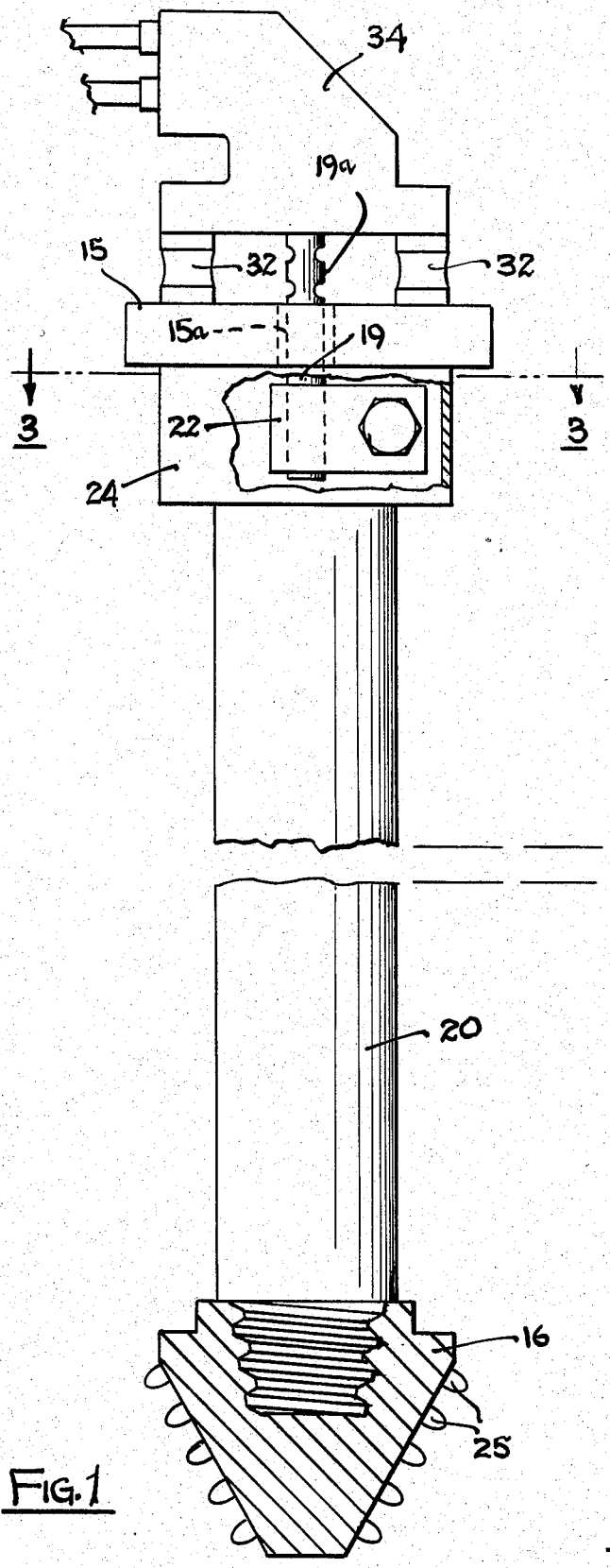
FIG. 1 is a elevational view, partially in cross section, of a first embodiment of the invention.
Figure 2:
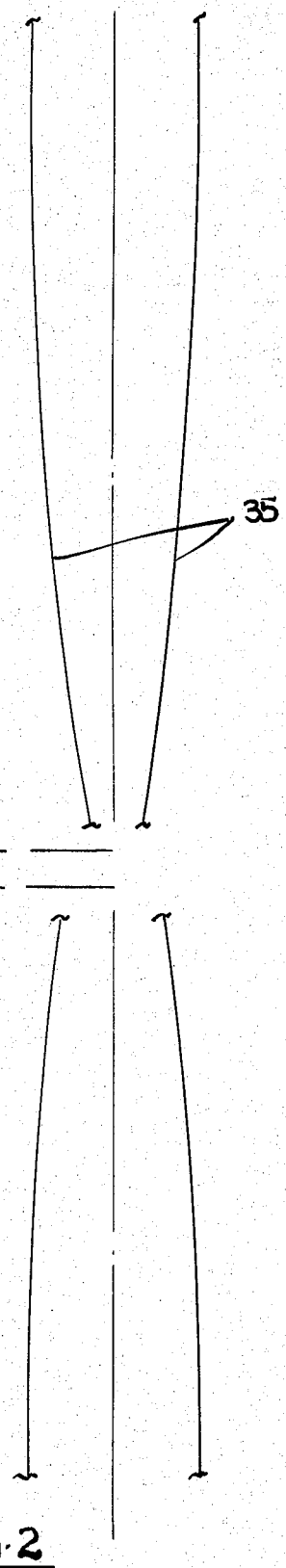
FIG. 2 is a wave pattern illustrating the standing waves generated in the embodiment of FIG. 1.
Figure 3:
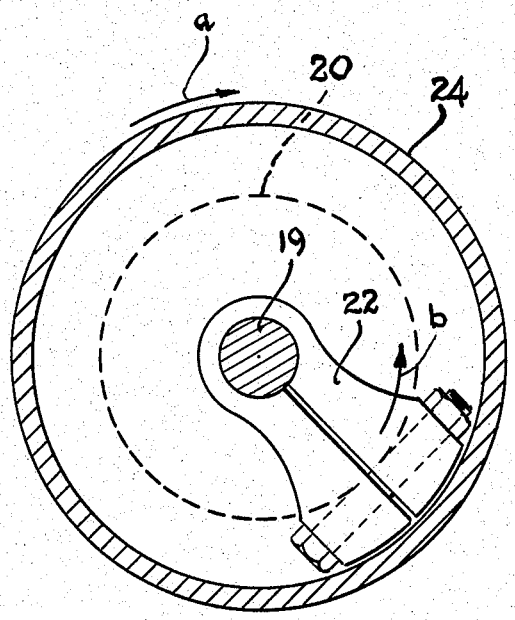
FIG. 3 is a cross-sectional view taken along the plane indicated by 3—3 in FIG. 1.

Referring now to FIGS. 1-3, a first embodiment of the invention is illustrated. The casing of orbiting mass oscillator 24 is mounted firmly in energy transmission relationship to drill stem 20, this orbiting mass oscillator having bearing 15*a* which carries shaft 19 having an eccentrically weighted rotor 22 which is rotatably driven in the direction indicated by arrow "b" by flexible drive shaft 19*a*. Motor 34 is mounted on platform 15 on vibration isolators 32, shaft 19*a* being the drive shaft of this motor. Attached to the housing of orbiting mass oscillator 24 is drill stem 20 which at its lower end has a drill bit 16 attached thereto. When rotor 22 is rotatably driven, it generates a cycloidal vibratory force in drill stem 20. Rotor 22 is preferably driven at a frequency such as to set up resonant standing wave vibrations in quadrature phase in the drill stem, as indicated by graph lines 35 in FIG. 2. For an explanation of cycloidal or quadrature vibration, reference is made to my aforementioned U.S. Pat. Nos. 4,271,915 and 4,266,619. This cycloidal energy is transferred to drill bit 16 and causes the drill bit to nutate around the side wall of the bore hole in the direction indicated by arrow "a", the side cutter teeth chipping away the sides of the bore hole while the bottom teeth chip away the bottom of the hole.

Figure 4:
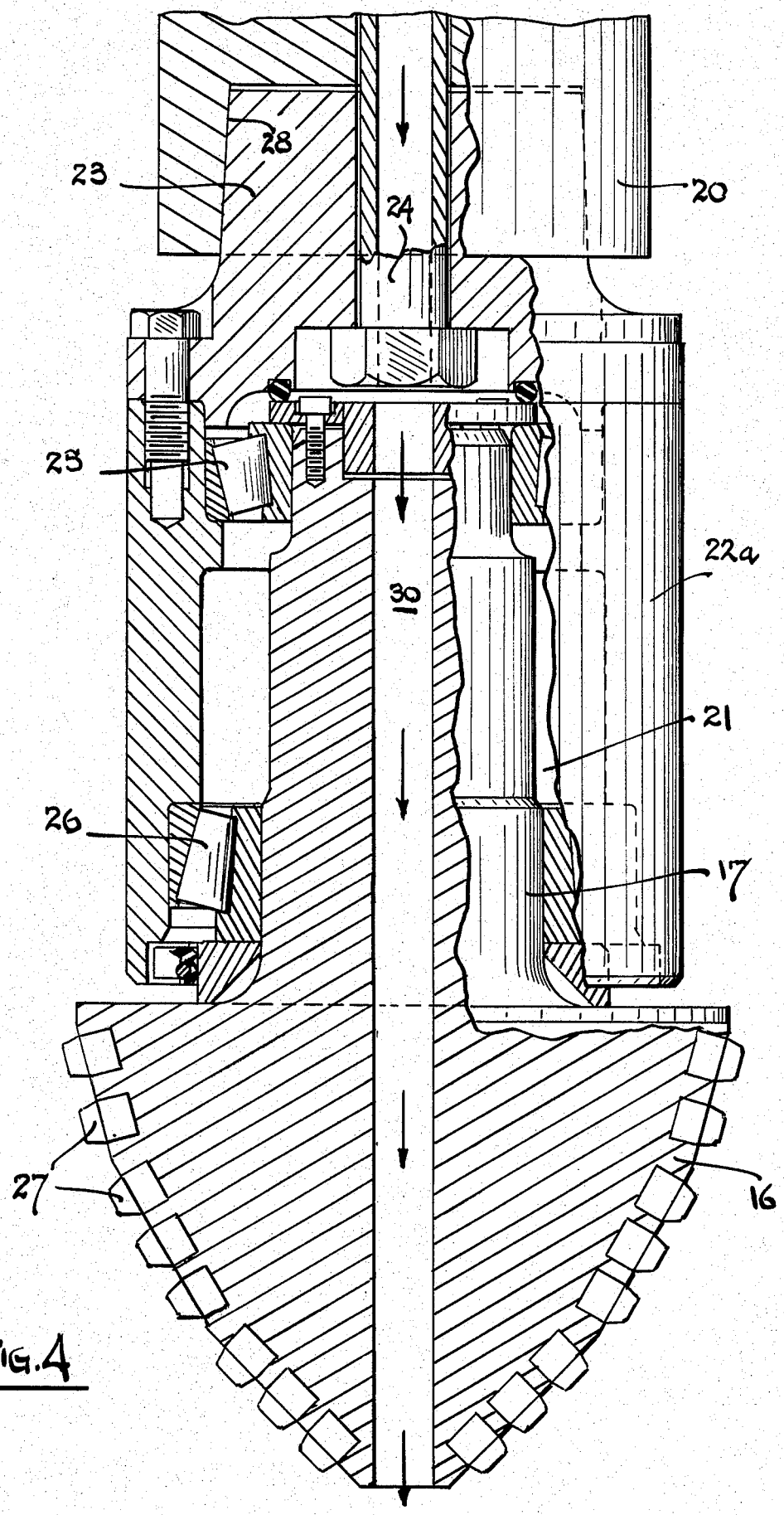
FIG. 4 is a cross-sectional view in elevation illustrating a second embodiment of the invention.

Referring now to FIG. 4, a second embodiment of the invention is illustrated. In this embodiment, bit 16 has a geometrical shape which is a figure of revolution which starts as a cylinder at the greatest diameter and in going toward the center comprises a series of successive steps in the form of truncated cones. Tungsten carbide cutter teeth inserts 27 are pressed into the cone after the predrilling of undersized holes to receive these teeth, in a manner well-known in the art. Bit 16 has an integral shaft portion 17 which extends into bearing socket 21 formed in bearing assembly 22*a*. Bearing assembly 22*a* has a pin member 23 which matingly fits into socket 28 formed in the drill stem 20. The bearing assembly 22*a* is retained to stem 20 by means of tension bolt 24 which threadably engages the drill stem at a position therealong which is not shown in the drawing. Bit 16 is supported in socket 21 on roller bearings 25 and 26 which permit free rotation of the bit while carrying both radial and longitudinal loads. The oscillator construction for the second embodiment is the same as that for the first, or may use the oscillators shown in my U.S. Pat. Nos. 4,271,915 or 4,266,619, and provides cycloidal, vibratory energy to stem 20 which energy is transferred through bearing housing 22 to the bit. This cycloidal force pattern of said stem vibrating in quadrature as described causes the bit to precess or roll around the wall of the bore hole in orbiting fashion; this end result being achieved without the need for rotating the stem. A central bore 30 is provided in the drill bit and stem to permit the flow of mud to the drilling area for flushing out the cuttings and cooling the bit.

Figure 5:
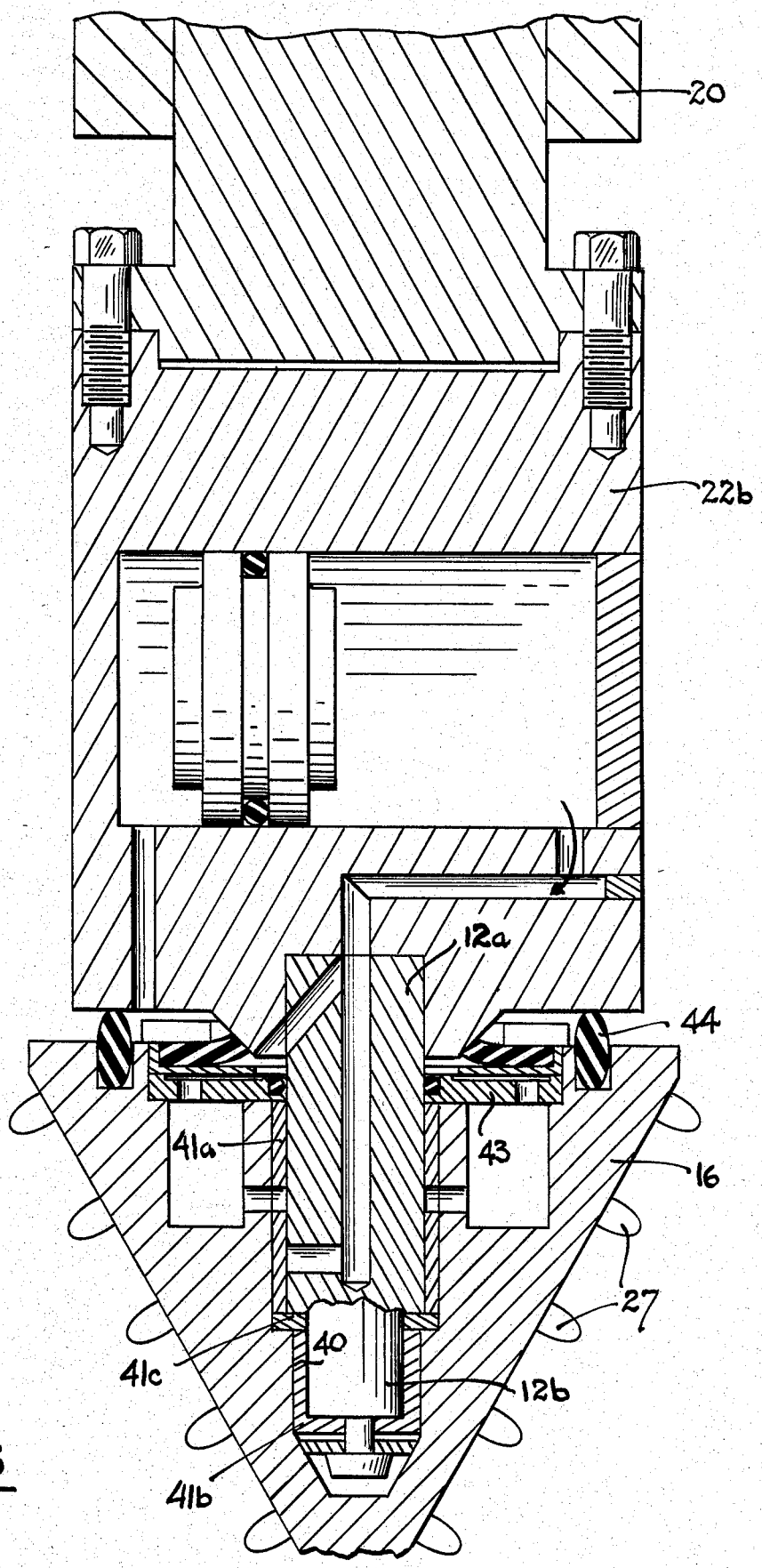
FIG. 5 is a cross-sectional view in elevation illustrating a third embodiment of the invention.

Referring now to FIG. 5, a further embodiment of the invention is illustrated. As for the previous embodiment, this embodiment employs the same type of oscillator structure as that of the first embodiment or as shown in my '415 to '619 patents. The bit 16 is a cone bit which incorporates bearings in the body of the bit itself. This bit and bearing structure is described in my copending application Ser. No. 362,886, filed Mar. 29, 1982. The bit is supported on support mandrel 22*b* by means of a bearing pin which includes two cylindrical sections 12*a* and 12*b*, the latter of these sections being stepped down in diameter to provide bearing support for the small end of the conical bit. The inner walls of hollowed out portion 40 have sleeve bearings 41*a*, 41*b*, and 41*c* fixedly attached thereto or formed thereon. These bearings may be of a highly durable material such as nitralloy, high pressure bronze, or fabricphenolic, which will work with water as part or all of its lubricant. As described in my prior application Ser. No. 362,886, a disc member 43 is fixedly attached to and rotates with the bit cone, this disc operating as a slinger to drive particulate material centrifugally outwardly away from the bearings. A light pressure O-ring seal 44 is installed in a channel formed in the body of the cone to provide sealing action, particularly during storage and shipping. The immediately above described structure is involved with the centrifugal lubrication system described in my aforementioned application Ser. No. 362,886 and is not involved with the present invention. The present invention employs a rotatable bit 16 which is free to rotate on sleeve bearings 41*a*-41*c*. Cycloidal energy is applied to drill stem 20 causing vibration in quadrature in the same manner as with the previous embodiments, this cycloidal energy being coupled to the bit and causing it to rotate against the bore wall in a precessional manner on the support bearings such that the bit orbits around the bottom of the bore hole.

Figure 6:
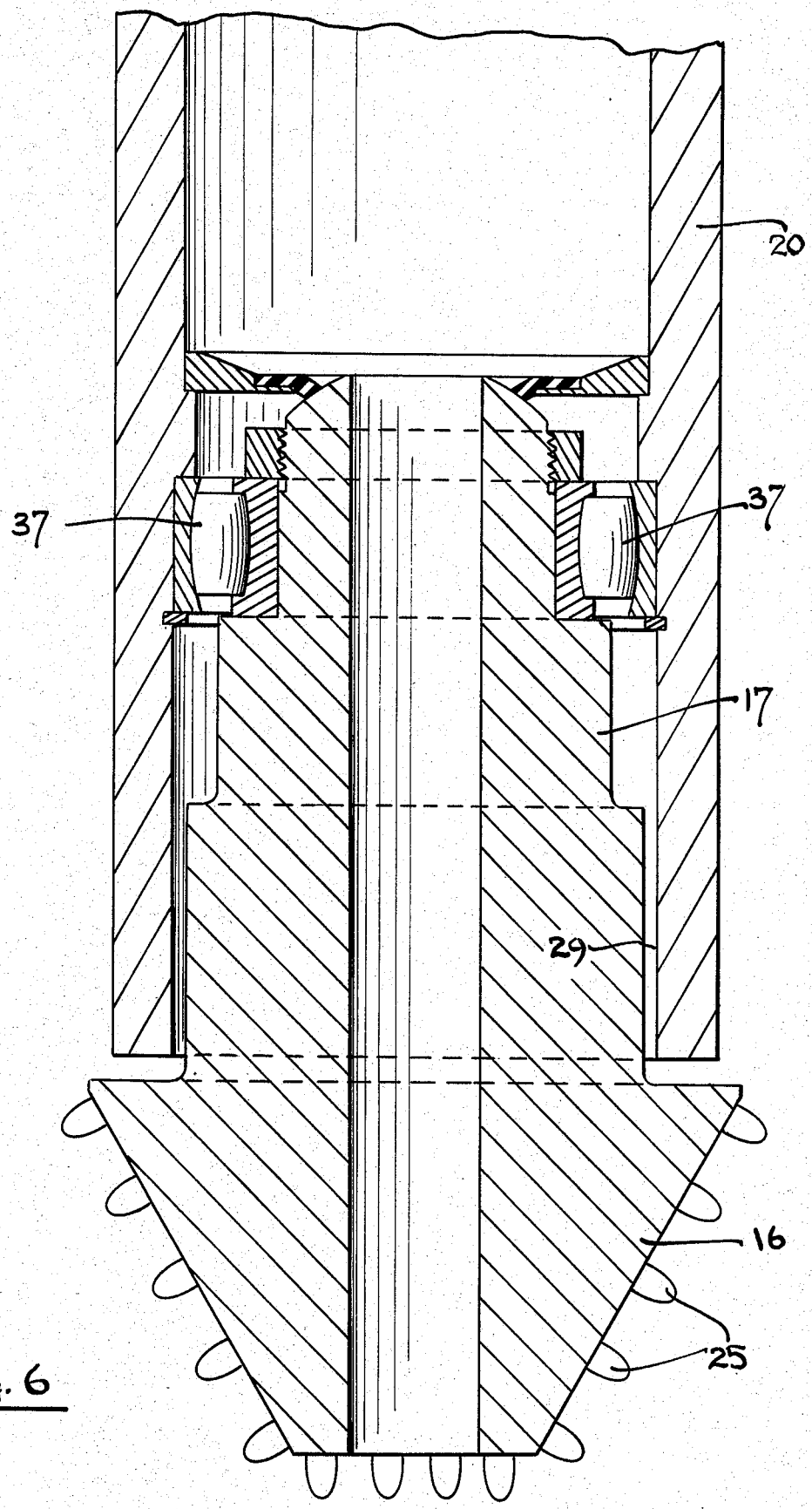
FIG. 6 is a cross-sectional view in elevation illustrating a fourth embodiment of the invention.

Referring now to FIG. 6, a further embodiment of the invention is shown. In this embodiment, bit extension 17 which is integral with bit 16 is carried on the end fof stem 20 by a single spherical roller bearing unit 37. A portion of bit extension 17 which is adjacent to the open bottom end of stem 20 is fitted at 29 loosely so that the extension 17 is free to pivot in spherical bearing 37. With cycloidal vibratory energy applied to stem 20, as in the previous embodiments, the lower end of stem 20 vibratorily strikes at 29 against bit extension 17 with a cycloidal precessional motion. The clearance between the stem 20 and the bit extension 17 at 29 affords an acoustic rectifier action which delivers powerful cyclical force pulses to the bit from the cycloidally vibrating stem 20. Further, this rectifier mechanism permits strong downward bias through the swivelling spherical bearing 37, as well as sidewise bias, without the bit becoming completely locked to the lower end of the drill stem. Even though the bias force is quite large, the lower end of stem 20 is relatively free from the bit assembly. This permits the stem to have a fairly high acoustical "Q" in a resonant vibration system, in that it is only tightly coupled to the drill bit during a portion of each vibrational cycle. Rocking action at spherical bearing 37 gives the teeth a downward striking action also.

Figure 7:
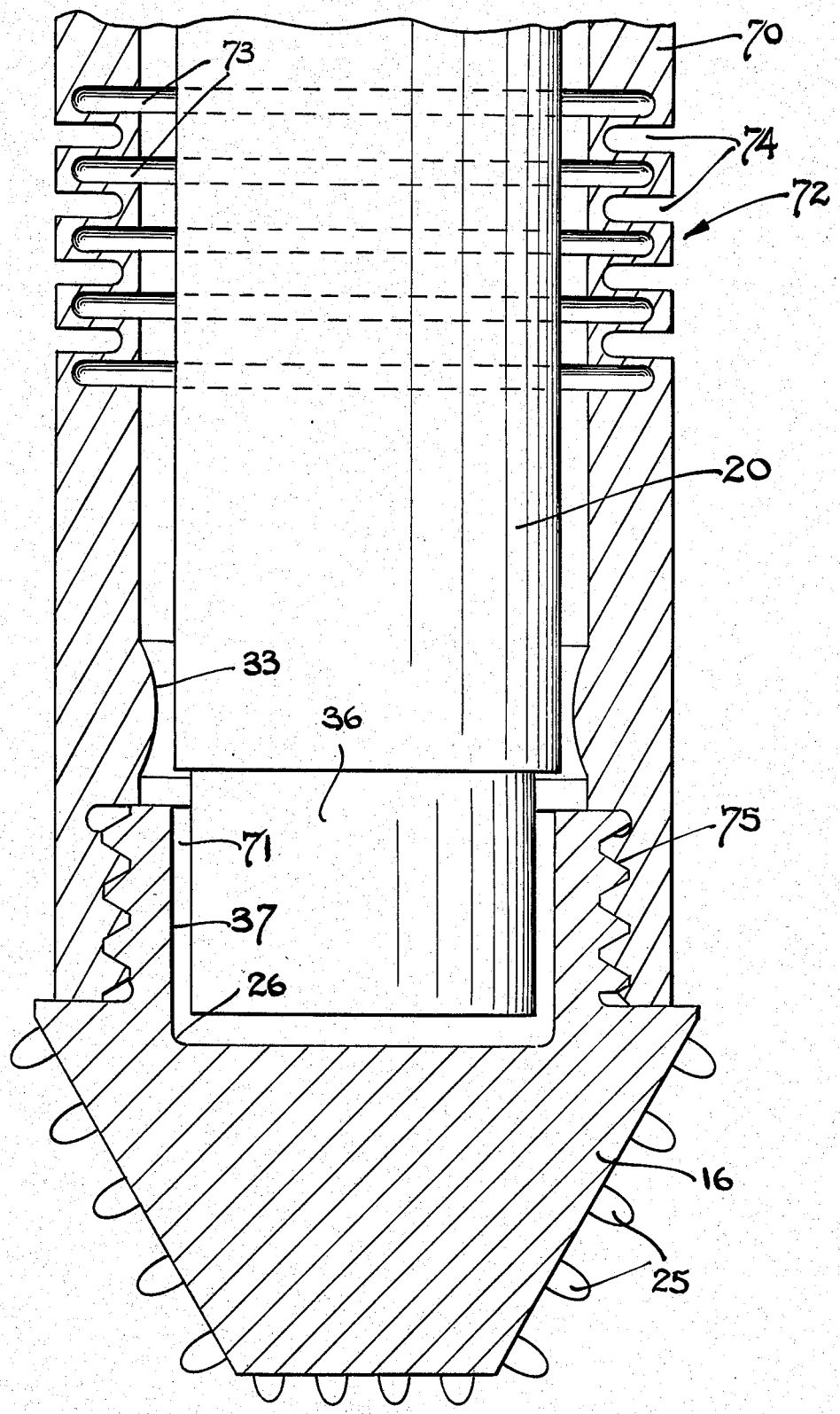
FIG. 7 is a cross-sectional view in elevation illustrating a fifth embodiment of the invention.

Referring now to FIG. 7, still a further embodiment of the invention is illustrated. In this embodiment, a jacket 70 is employed, bit 16 being attached to the lower portion of this jacket by threadable engagement therewith as indicated at 75. Sonic isolation is provided between the bit and the lower part of jacket 70 by means of a bellows structure 74 which is formed by means of alternate grooves in the jacket. Stem 20 is contained within the jacket in spaced relation thereto, the stem being sonically driven by an orbiting mass oscillator, as in the previous embodiments or as shown in patents '619 or '915. The end portion 36 of stem 20 has a pin shape which fits loosely in socket 71 formed in the top of the bit. The cycloidal energy imparted to stem 20 from the oscillator causes the pin shaped end 36 of the stem to cycloidally drive bit 16 at 71 causing the bit to nutate around the bottom of the bore hole in precessional fashion. Stem member 20 (including the end portion 36 thereof) drives against surfaces 33, 37 and 26 in cycloidal fashion in achieving the driving action of the bit. A portion of the lateral driving force is translated into longitudinal force with the engagement of the edges of stem portion 36 against radius 26 formed at the lower corner of socket 71 of the bit. This applies downward thrust along with the lateral thrust in implementing the cutting action of the teeth 25.

It is to be noted that in situations where stem members 20 is vigorously driven in a resonant mode of vibration, "rectifier" action can be achieved, i.e., the stem may only contact the lower portions of the jacket and the bit during a portion of the vibration cycle, being free from such contact during the remaining portion of the cycle. As already noted, this can greatly increase the Q (figure of merit) of the resonant vibration to afford a marked increase in the vibratory drive force.

Figure 9:
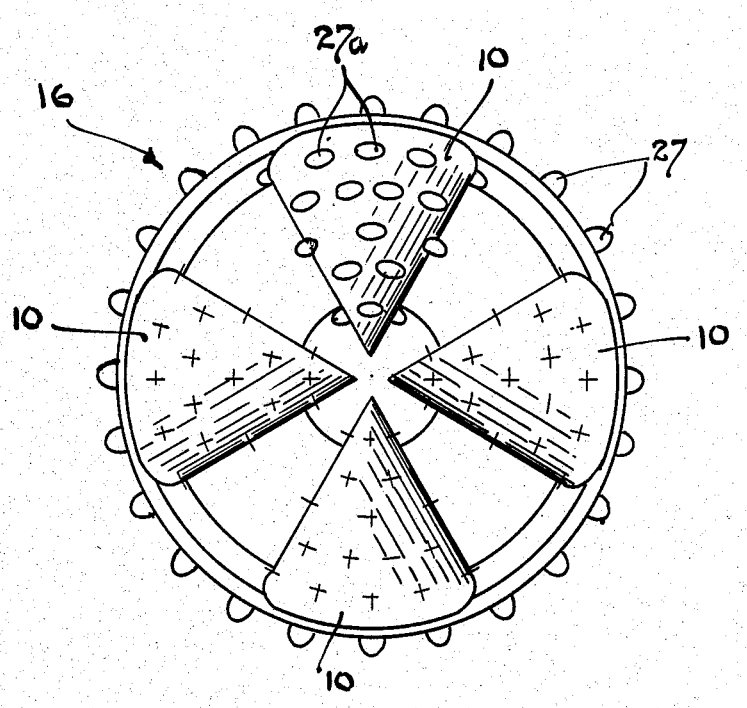
FIG. 9 is a bottom plan view of the embodiment of FIG. 8.
Figure 8:
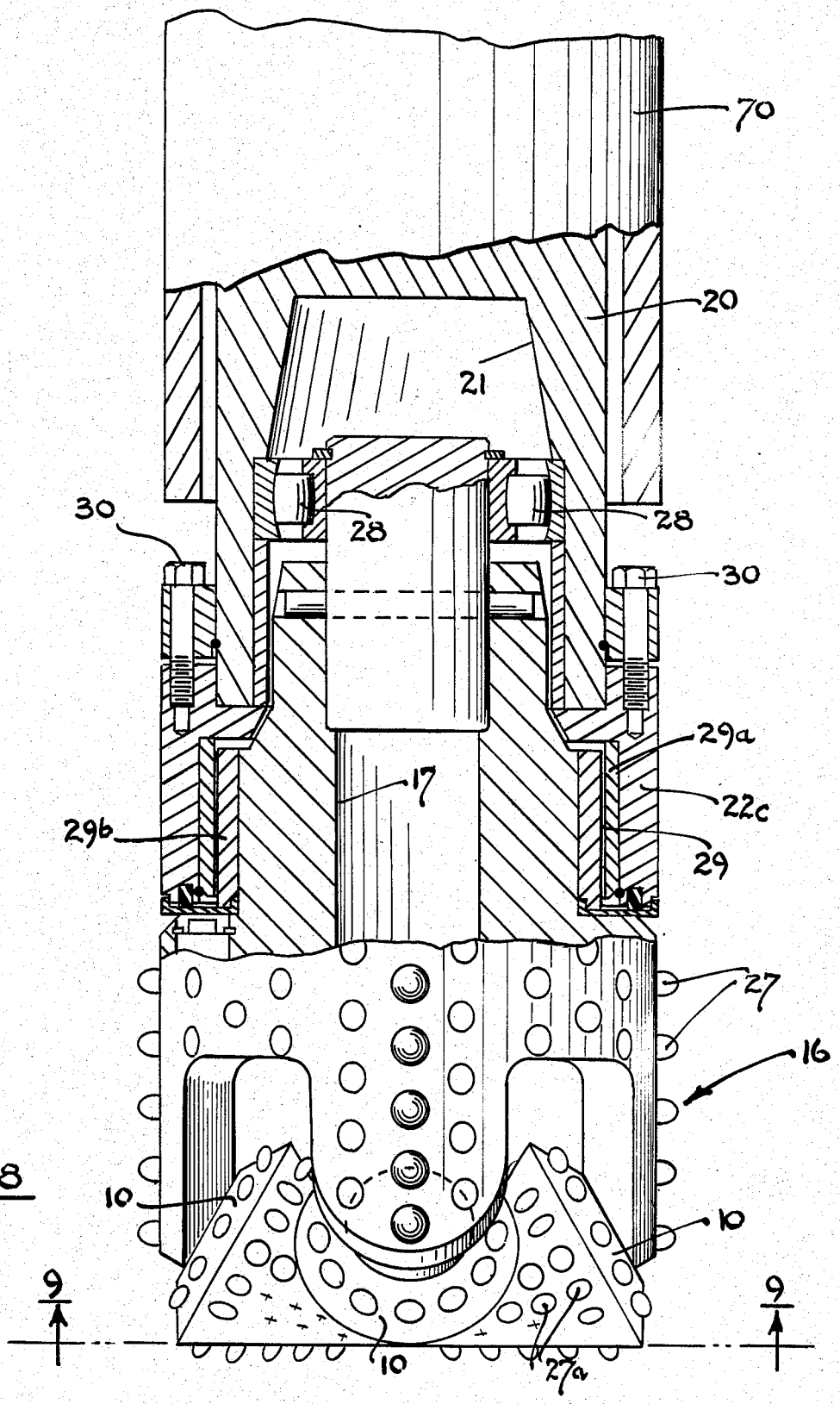
FIG. 8 is a cross-sectional view in elevation illustrating a sixth embodiment of the invention.

Referring now to FIGS. 8 and 9, still a further embodiment of the invention is illustrated. In this embodiment, a somewhat conventional multiconed bit 16 is employed which comprises a plurality of roller cone bit elements of a commercially available type. The bit assembly 16 has an integral stem portion 17 which extends into bearing socket 21 formed in the bottom of drill stem 20. Stem portion 17 is rotatably supported on the drill stem 20 on a spherical roller bearing 28. A collar **22*c* is attached to the bottom of stem 20 by means of bolts 30, a sleeve bearing 29 being formed between bearing ring 29*a*, which is press fitted to collar 22*c* and bearing ring 29*b* which later is press fitted onto the bit assembly 16. In this embodiment, the stem 20 is contained within a jacket 70 and is cycloidally driven as in patents '619 and '915. The cycloidal forces are applied to the bit through both bearings 28 and 29 to cause the bit assembly 16 to nutate as well as to rotate about its longitudinal axis on these bearings. This results in the bit precessing or orbitally rolling about the bottom of the bore hole with cutting tooth inserts 27 gripping and precessionally cutting the side walls while the teeth 27*a* of the conical bit elements 10 drill against the bottom of the bore hole and simultaneously aiding in the cycloidal traction of the whole bit assembly. The nutating action of the drill bit, further, facilitates the drilling action of the teeth 27*a*** of the rolling cone bit elements by virtue of the downward (longitudinal) cyclic forces provided in this nutating action.

Figure 10:
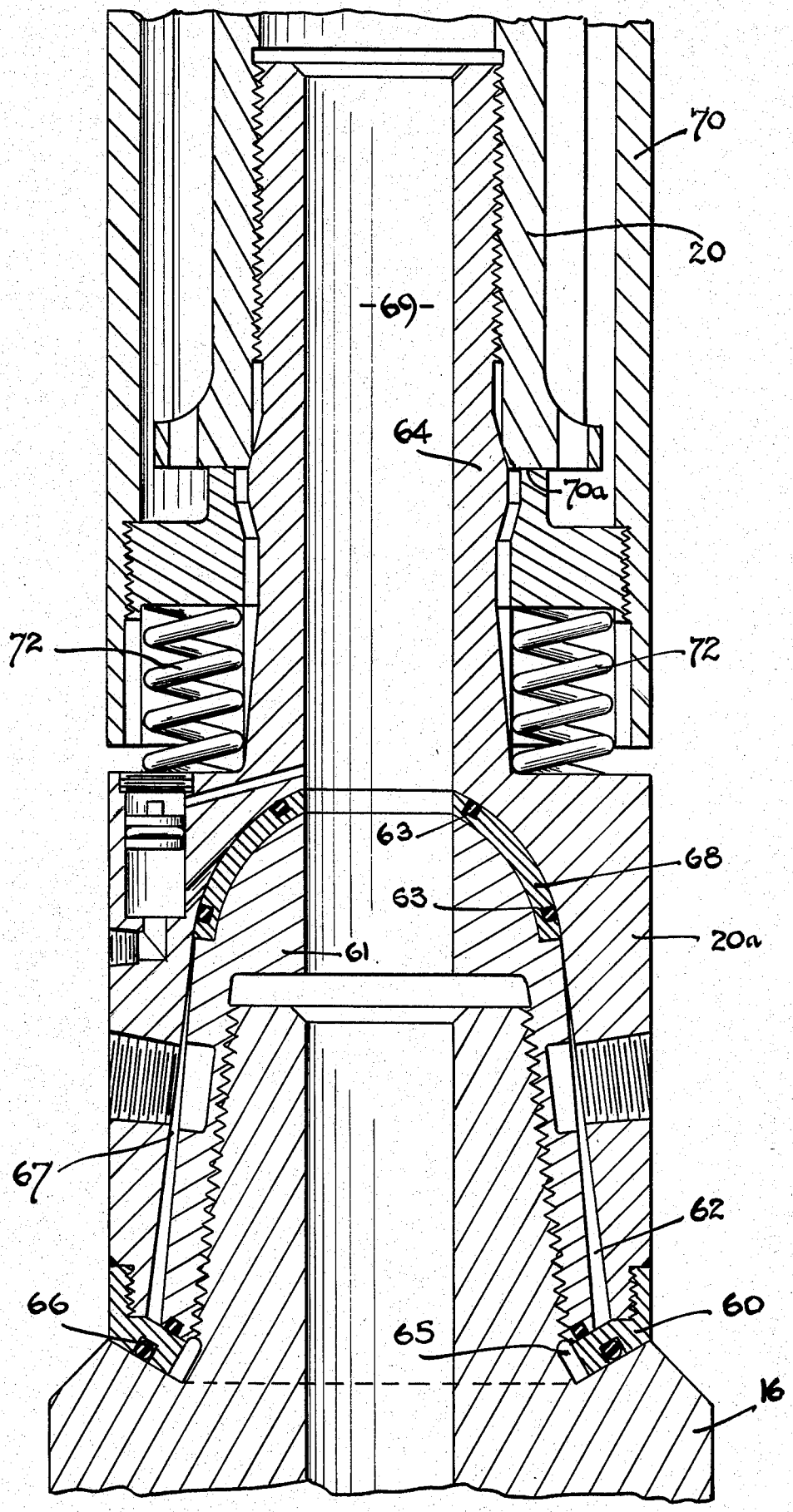
FIG. 10 is a cross-sectional view in elevation illustrating a seventh embodiment of the invention.
Figure 11:
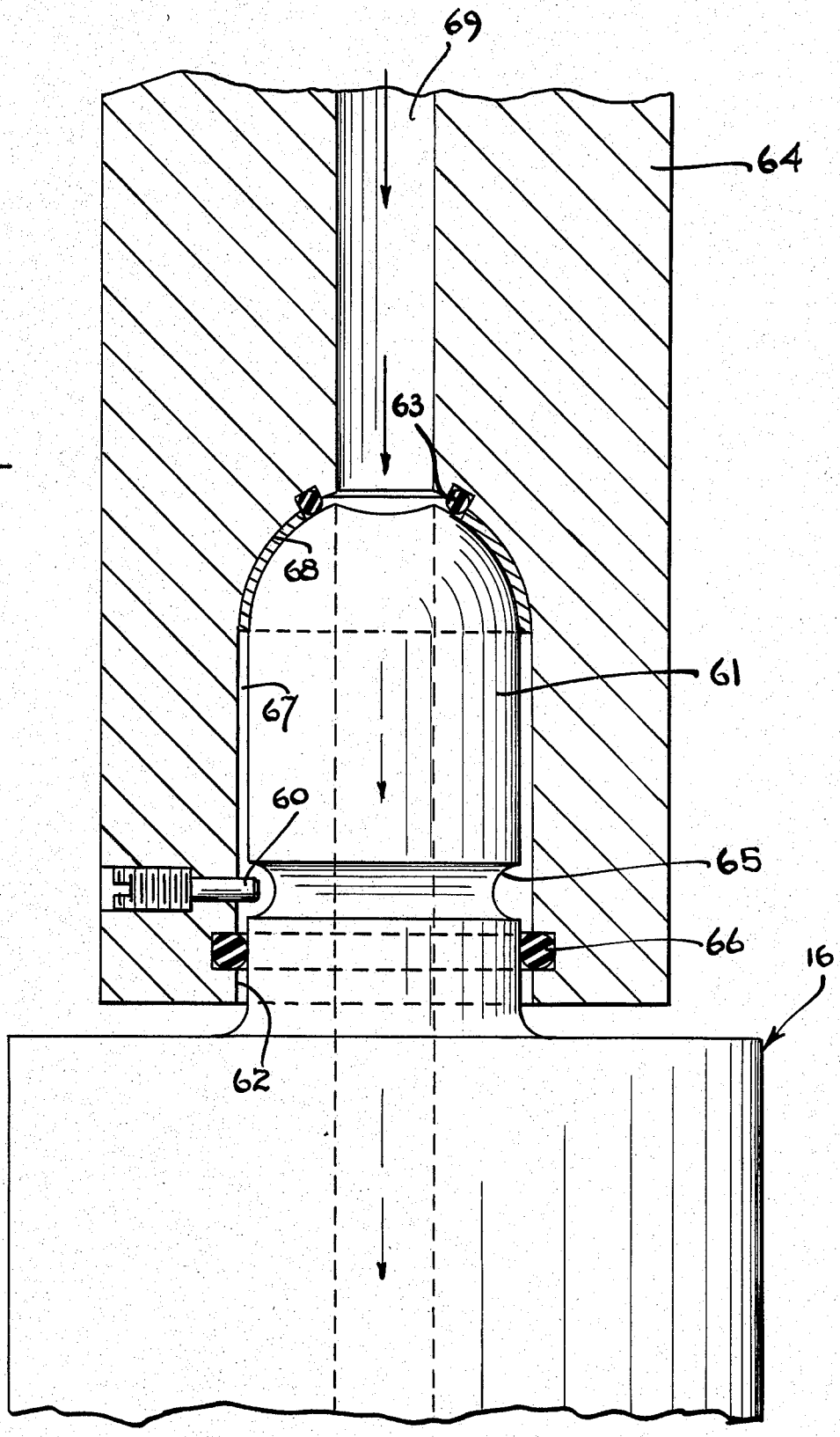

Referring now to FIG. 10, a further embodiment of the invention is illustrated, this embodiment being particularly adapted for use in drilling earthen formations requiring substantial down pressure of the bit against the formation and down vibration component also. Threadably attached to the upper portion of bit assembly 16 is a dome shaped member 61 which is mounted in a mating socket 67 formed in the bottom end of drill stem extension **20*a* which is threadably attached to drill stem 20. Dome shaped member 61 has a bearing pad 68 formed along the top portions thereof, this bearing pad having a truncated, hemispherical shape and being fabricated from a material capable of handling high loads, such as a Teflon fiberglass matte or a high pressure, sintered metal matrix. Jacket 70 is resiliently engaged against stem extension 20*a* by means of springs 72 which provide vibrational isolation for the jacket. The bit 16 is retained in position on stem extension 20*a* by means of retainer ring 60 which threadably engages stem extension 20*a* and against which the bottom edge of dome shaped member 61 abuts. A heavy O-ring 66 is mounted in a groove formed in the bottom of retainer ring 60, this O-ring helping to prevent foreign material from entering socket 67. Grease is placed in the circular annulus of socket 67 around 61 to provide lubrication for the bearings. Circulation fluid is fed to the bit through central passage 69 to flush out the drilled cuttings, O-ring seals 63 being provided in bearing 68** to minimize leakage of such circulation fluid into the bearings.

With cycloidal sonic energy applied to stem 20 in the same manner as described for the previous embodiments, the lower portions of the stem 20 and extension **20*a* will rock or precess by virtue of the loose fit between the stem extension 20*a* and bit 16 (indicated at 62). This rocking or precessing action results in sonic rectification in this loosely fitting area with the stem extension 20*a* cyclically hitting against the extension portions of the bit during only a portion of the precessional vibration cycle. Downward bias through jacket 70 compresses springs 72 and causes a gap at 70*a*, thus leaving stem 20 and extension 20*a* free to vibrate in quadrature. The bit 16 is driven cycloidally in orbiting fashion around the bottom of the bore hole in response to the vibratory force applied thereto. The cycloidal action causes the bit to also rotate whereby bearing 68 spins as well as rocking. With the drill stem being cycloidally driven in a resonant quadrature vibration mode, high vibrational force can be attained as compared with prior art drills wherein the drill bit is fastened tightly and directly to the resonant stem. This is in view of the fact that a higher "Q" (figure of merit) can be achieved in view of the fact that the resonant stem is free of the lateral load during a portion of the vibration cycle and thus is not heavily damped laterally even with the bit pressed tightly or biased against the bore hole by jacket 70. The freely rocking bearing action attained at bearing 68 allows the bit to vibrate laterally as well as having the bit spin while the down load is being carried by the bearing. Moreover, the rocking bit vibration causes the cones to vibrate vertically against the bottom. The resonant stem extension 20*a* is free to vibrate laterally with bearing 68** functioning as a pivot and swivel. As already mentioned, the resonant stem member, in view of the rectifier action which leaves the stem member free of the load during at least a portion of the vibration cycle, is not heavily damped with substantial longitudinal down bias, thereby enabling the coupling of greater downward bias force to the load.

I claim:

1. In a drill for drilling a bore hole in earthen material, said drill having a drill stem and a drill bit coupled to said drill stem, orbiting mass oscillator means for generating cycloidal vibratory energy, and means for coupling the vibratory energy generated by said oscillator to said drill stem, said energy being coupled to said drill stem to generate a cycloidal vibratory force pattern in said stem about the longitudinal axis thereof, said drill bit having teeth thereon which engage both the side and bottom walls of said bore hole, the cycloidal vibratory energy being coupled to said drill bit to effect cycloidal precessional motion of the bit around the bore hole simultaneously providing cutting action about both the sides and bottom walls of said bore hole.

2. The drill of claim 1 wherein said oscillator means is operated at a frequency such as to effect resonant standing wave vibration of said stem.

3. The drill of claim 1 wherein said bit is conically shaped.

4. The drill of claim 1 wherein the drill stem is tightly coupled to the drill bit, the drill bit nutating around the bore hole in response to the vibratory energy.

5. The drill bit of claim 1 and further including rotary bearing means for coupling the drill bit to the drill stem, said bearing means permitting rotation of said bit about the bore hole in response to the cycloidal force in orbiting fashion.

6. The drill of claim 5 wherein said bearing means permits limited lateral movement between the bit and the stem such that the stem is free of the bit during a portion of the vibration cycle, the sonic energy being coupled through the bearing means from the stem to the bit in unidirectional pulses.

7. The drill bit of claim 5 wherein said bearing means comprises roller bearings.

8. The drill bit of claim 5 wherein said bearing means comprises sleeve bearings.

9. The drill bit of claim 5 wherein said bearing means comprises a spherical bearing.

10. The drill bit of claim 5 wherein said bearing means comprises a dome shaped member attached to the bit and a socket formed in the stem which mates with said dome shaped member, said dome shaped member being loosely fitted in said socket such that the cycloidal energy generated in the stem causes the socket to drive against the dome shaped member during only a portion of the vibrational cycle, thereby to effect orbital precessional driving action of the bit against the bore hole.

11. The method of claim 10 wherein the cycloidal energy is coupled to the drill bit in unidirectional pulses during only a portion of each vibration cycle.

12. A method for drilling a bore hole having a wider gauge than that of the drill bit comprising applying sonic energy to a drill stem in a cycloidal mode of vibration about the longitudinal axis of said stem, and coupling the cycloidal energy to a drill bit having teeth both about the sides and bottom portions thereof to cause the drill bit to be cycloidally driven around the bore hole to effect both lateral and longitudinal drilling of the bore hole.

13. The method of claim 12 wherein the sonic energy is at a frequency such as to effect resonant standing wave vibration of the drill stem.

* * * * *